United States Patent [19]

Knibbe

[11] 3,991,641

[45] Nov. 16, 1976

[54] PIERCING APPARATUS

[75] Inventor: Jan C. Knibbe, Detroit, Mich.

[73] Assignee: Springfield Tool & Die, Inc., Dearborn, Mich.

[22] Filed: July 18, 1975

[21] Appl. No.: 597,178

[52] U.S. Cl. ..... 83/440.1; 83/527; 83/564; 83/571; 83/574; 83/698

[51] Int. Cl.[2] ..... B26F 1/02

[58] Field of Search ..... 83/574, 571, 548, 549, 83/550, 623, 564, 563, 440, 440.1, 698, 527

[56] References Cited

UNITED STATES PATENTS

| | | | |
|---|---|---|---|
| 2,596,911 | 5/1952 | Nelson | 83/440.1 |
| 3,066,566 | 12/1962 | Bottenhorn | 83/623 |
| 3,640,167 | 2/1972 | Axtmann | 83/623 X |
| 3,698,273 | 10/1972 | Richard | 83/267 X |
| 3,835,744 | 9/1974 | Wendt | 83/411 R |
| 3,863,534 | 2/1975 | Scott | 83/623 X |
| 3,878,746 | 4/1975 | Carmeli | 83/623 X |

*Primary Examiner*—J. M. Meister
*Attorney, Agent, or Firm*—Gifford, Chandler, Sheridan & Sprinkle

[57] ABSTRACT

Apparatus for piercing an arcuate workpiece includes a frame, an index table rotatably mounted on the frame, the workpiece being mounted to the index table, and piercing apparatus horizontally adjustable on the frame with respect to the index table. The piercing apparatus includes a pair of tool receiving heads each of which can receive either a punch or a die and means for selectively fixing the particular head used to receive the die and for moving the punch receiving head into and out of engagement with the workpiece so that the workpiece can be pierced from either side. Roller means are provided to facilitate changing the tooling and a stock guide is provided which is reversible so that it can be used regardless of which tool receiving head is being used as the die receiving head.

15 Claims, 7 Drawing Figures

PIERCING APPARATUS

BACKGROUND OF THE INVENTION

1. Field of the Invention

The present invention relates to piercing apparatus and more particularly to such an apparatus including a horizontally movable piercing means for piercing an arcuate workpiece.

2. Description of the Prior Art

Heretofore the removal of portions of arcuate workpieces has required a difficult and expensive machining operation. This has in the past taken the form of essentially hand machining each section to be removed. This, of course, is very expensive and where a number of machining operations are required on each workpiece results in substantial waste losses caused by improper machining of one portion when other portions have been completed.

Some efforts have in the past been made to machine such parts of electrical discharge machining (EDM) or electrical-chemical machining (ECM) but for a number of reasons these methods are not entirely satisfactory.

Because of these difficulties the fabrication of turbine or rotor wheels, for instance, has heretofore been accomplished by joining the blades to the arcuate rotor or turbine without the aid of locating apertures or slots. Since such blades must be precisely located and must be oriented properly, fixing them while welding or a like joining process is performed is very difficult.

SUMMARY OF THE PRESENT INVENTION

The present invention provides an apparatus for automatically piercing an arcuate workpiece such as a turbine, a rotor, or the like and indexing the workpiece to a new position to be pierced again. This method eliminates the need for hand machining, EDM, ECM or the like and permits a turbine or rotor to be produced with accurately positioned and dimensioned slots for receiving and locating the turbine blades.

A frame is provided which supports a horizontally operable punch head and a die head. The workpiece is mounted to a rotatable index table and is indexed to successive positions intermediate the punch head and the die head.

The punch and the female die are interchangeable between a pair of spaced tool receiving heads and means are provided to utilize the same cylinder to actuate the particular tool receiving head which is carrying the punch so that piercing can be accomplished from either side of the workpiece upon proper adjustment of the apparatus.

To facilitate this changeover of operation, roller means are provided to aid in removing and replacing the punch and die units. Also a stock guide is provided which can be used regardless of which tool head is being utilized to produce the punching function.

DESCRIPTION OF THE DRAWINGS

The present invention will be more apparent upon reference to the following description which refers to the accompanying drawing in which like reference characters refer to like parts throughout the several views and in which.

DESCRIPTION OF A PREFERRED EMBODIMENT

Figure 1:
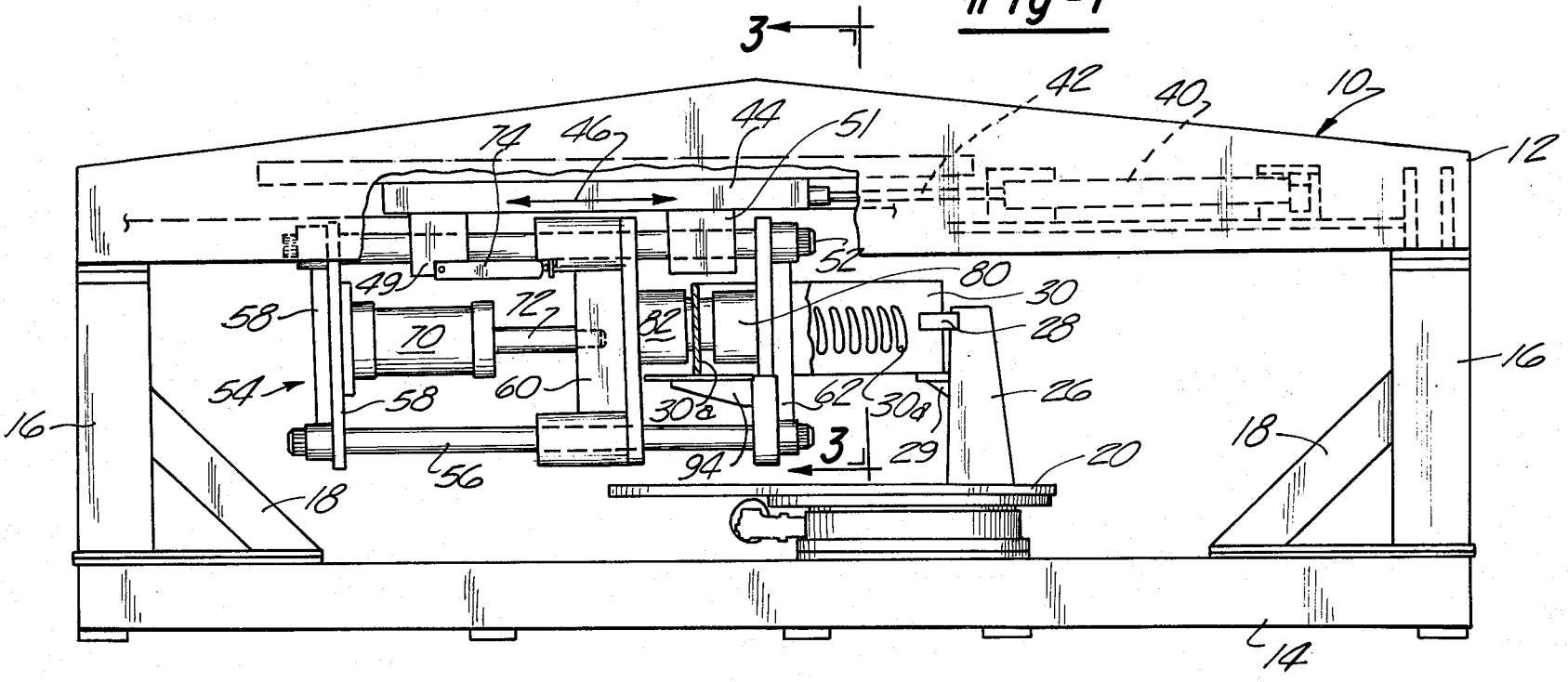
FIG. 1 is a side elevational view of the apparatus of the present invention with portions removed for purposes of clarity.

Now referring to the drawings for a more detailed description of the present invention, FIG. 1 illustrates a preferred embodiment as comprising a frame assembly 10 including substantially rectangular upper and lower members 12 and 14, respectively, and vertical uprights 16 joining the corners of the upper and lower members 12 and 14. Braces 18 extending between the uprights 16 and the lower member 14 add to the rigidity of the frame assembly 10.

An index table 20 is mounted to the lower member 14 of the frame assembly 10. The table 20 is rotatably mounted to the lower member 14 and is indexable to rotated positions by conventional means (not shown). A workpiece holder 26 extends upright from the top of the index table 20.

A clamp assembly 28 is mounted adjacent the upper end of the workpiece holder 26 and with a support 29 provides the means for mounting an arcuate workpiece 30 to the index table 20.

Still referring to FIG. 1 a cylinder 40 is fixed in the upper member 12 and has its rod 42 secured to a support 44 slidably mounted in the upper member 12 so that extension and retraction of the rod 42 produces movement of the support 44 in the direction of the arrows 46. Suitable means (not shown) are provided for actuating the cylinder 40.

Figure 3:
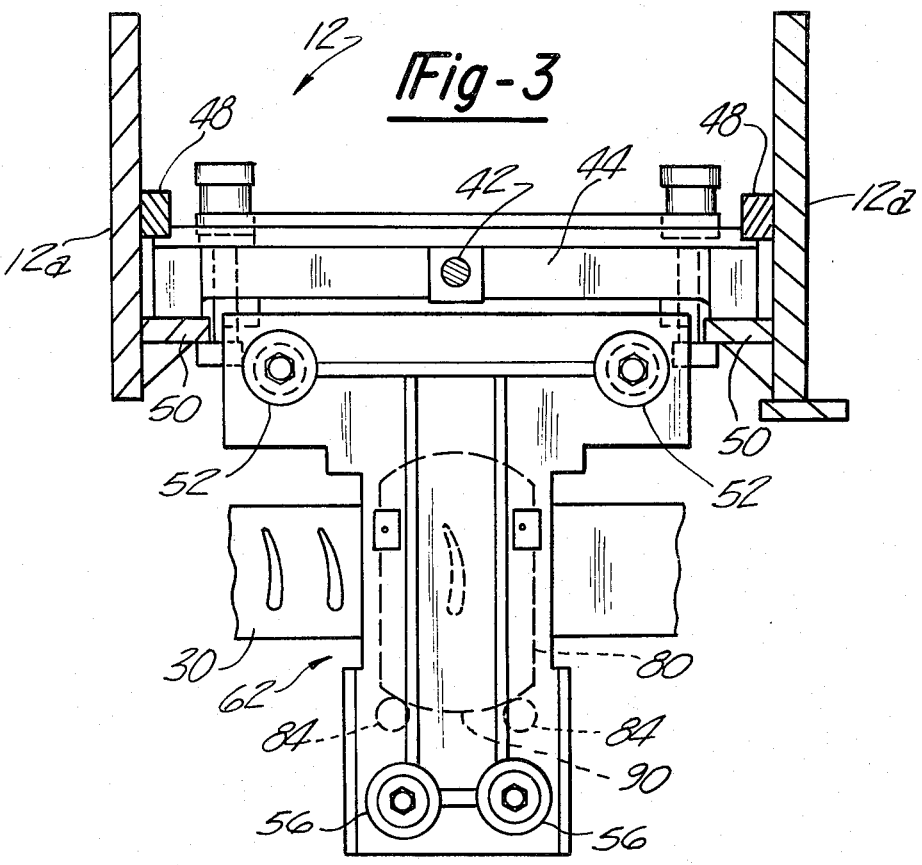
FIG. 3 is a view as seen substantially from line 3—3 in FIG. 1 and enlarged somewhat for purposes of clarity.

As can best be seen in FIG. 3, the support 44 is slidable in upper and lower ways 48 and 50 respectively which are formed in the interior of side walls **12*a* of the upper member 12**.

Referring again to FIG. 1 downwardly extending forward and rear support blocks 49 and 51 respectively are fixed to the slidable support 44 to be movable therewith. A pair of upper bars 52 extend through the support blocks 49 and 51.

Still referring to FIG. 1 a piercing means generally indicated at 54 is mounted to the bars 52 and to a pair of lower bars 56. The piercing means 54 includes a rear support plate 58 fixed to the bars 52 and 56, a first head member 60 slidably mounted to the bars 52 and 56 and a second head member 62 fixed to the bars 52 and 56. The workpiece 30 has a portion **30*a* positioned intermediate the heads 60 and 62** as can best be seen in FIG. 1.

An important feature of the present invention is that it can accomplish piercing of the workpiece 30 from either of two directions i.e. in the normal direction that is from the left in FIG. 1 or it can reverse pierce the workpiece. By reverse piercing it is meant that piercing can be accomplished from the right of FIG. 1. Piercing from one or the other direction is essential in some types of fabrication such as the provision of slots **30*b***

Figure 2:
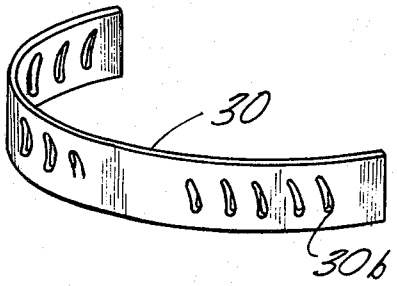
FIG. 2 is a perspective view of the type of workpiece that the apparatus of the present invention is intended to pierce.

(FIG. 2) to locate and position turbine blades on the inside or the outside surface of arcuate rotors.

Figure 4:
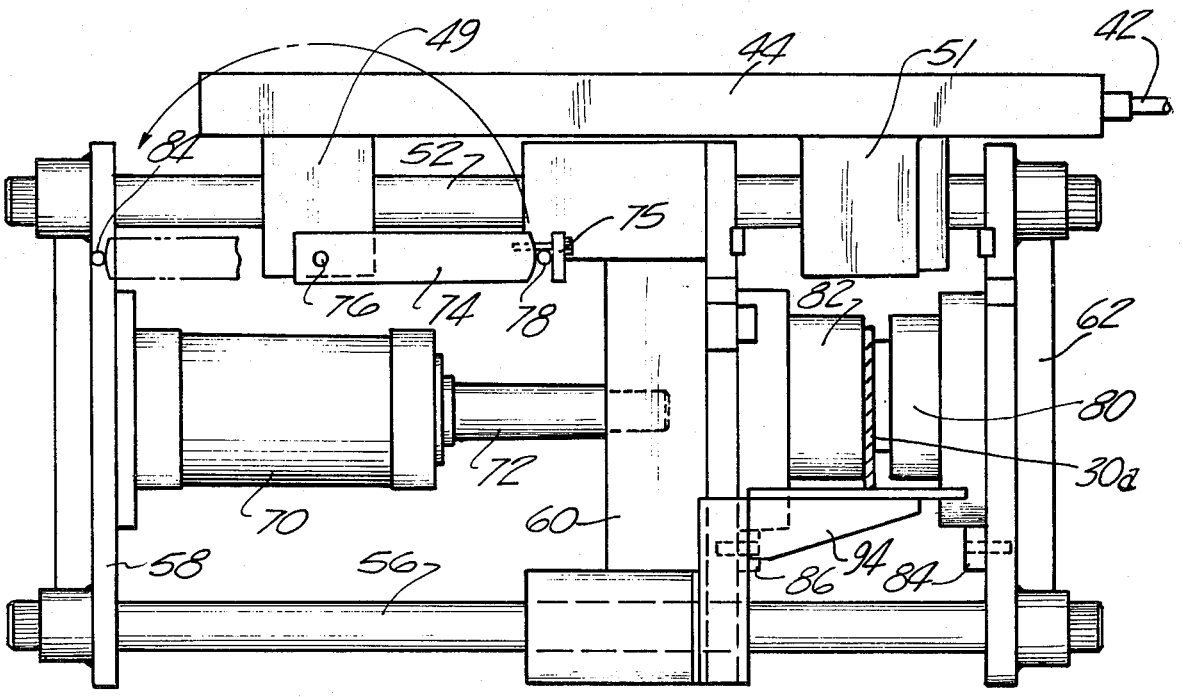
FIG. 4 is an enlarged view of a portion of the structure shown in FIG. 1.

As the apparatus is illustrated in FIGS. 1 and 4, piercing will be accomplished from the right. Thus the workpiece 30 will be subjected to reverse piercing. This is accomplished by a cylinder 70 which is mounted to the support plate 58 and has a rod 72 connected with the first head member 60.

As can best be seen in FIG. 4, a bar member 74 is pivotally connected to the support block 49 at a pivotal connection 76 and has a clamp portion 75 at the opposite end which is fastened to a pin 78 extending outwardly from the first head member 60. In this manner the first tool head 60 is prevented from moving by reason if its connection with the fixed support block 49. Extension of the cylinder 70 then will cause the plate 58 to move away from the first tool head 60 thereby moving the bars 52 and 56 to the left in FIGS. 1 and 4 and bringing a punching tool 80 carried by the second tool head 62 into engagement with the workpiece 30 and a die 82 carried by the first tool head 60.

When it is desired to pierce the workpiece 30 from the opposite direction the clamp portion 75 of the bar 74 is loosened and removed from the pin 78. The bar 74 is pivoted to the position shown in phantom lines in FIG. 4 and in solid lines in FIG. 5. The clamp portion 75 is secured to a pin 84 extending outwardly from the support plate 58.

With this arrangement the plate 58 is thus fixed with respect to the support block 49 and prevented from moving so that extension and retraction of the cylinder 70 produces a corresponding movement of the first tool head 60 toward and away from the second tool head 62. The second tool head 62 remains fixed by reason of its fixed connection with the support plate 58 through the bars 52 and 56. Thus the punching tool 80 would be mounted to the first tool head 60 and the die 82 would be mounted to the second tool head 62.

As can best be seen in FIGS. 3–6 to facilitate removal and replacement of the punching tool 80 and the die 82, rollers 84 are provided on the inside surface of the second tool head 62 and similar rollers 86 are provided on the inside surface of the first tool head 60.

Figure 6:
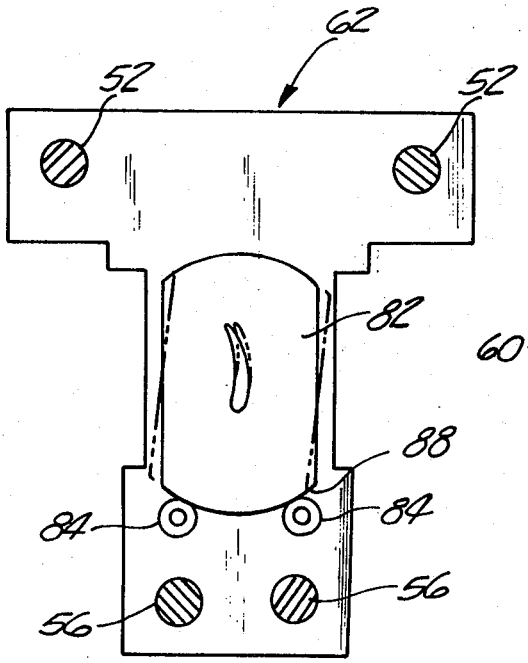
FIG. 6 is a view as seen substantially from line 6—6 of FIG. 5.

As can best be seen in FIG. 6 the die 82 is provided with an arcuate lower surface 88 which rides on the rollers 84 to facilitate positioning prior to locking the die 82 to the tool head 62. The punching tool 80 is provided with a similar lower arcuate surface 90 (FIG. 3) so that the rollers 84 and 86 cooperate with either the punching tool 80 or the die 82 regardless of which of these is used with the heads 60 and 62.

Referring to FIG. 4 when the tool head 62 is used to perform the punching operation a stock guide 94 is mounted to one or both sides of the first tool head 60 to support the lower edge of the workpiece 30.

Figure 5:
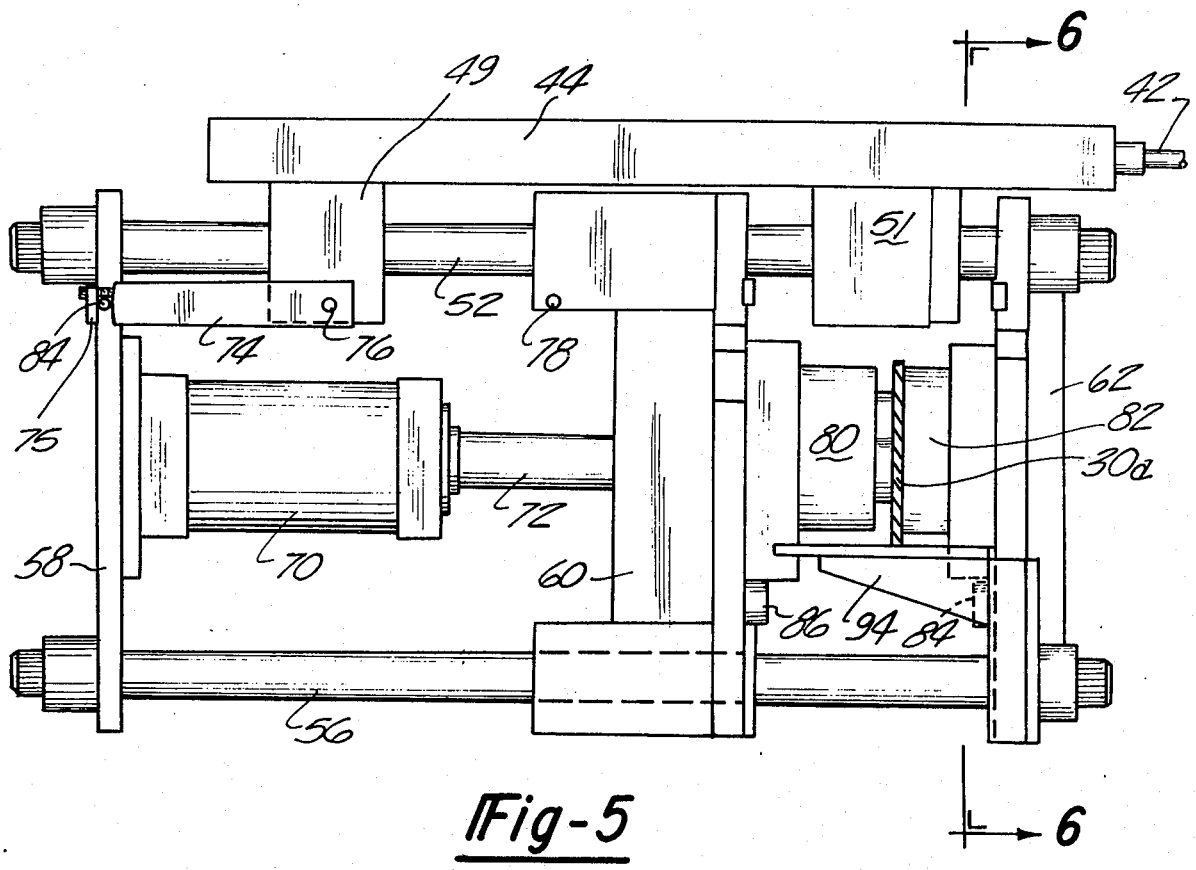
FIG. 5 is a view similar to FIG. 4 but illustrating the apparatus in a different operational mode.

As can best be seen in FIG. 5 the stock guide 94 is mounted to the second tool head 62 when the first tool head is utilized as the punching means.

Again to facilitate changing over from one mode of operation to the other, the stock guides 94 are made so that they can be used regardless of which head 60 or 62 is being used to perform the punching operation.

Figure 7:
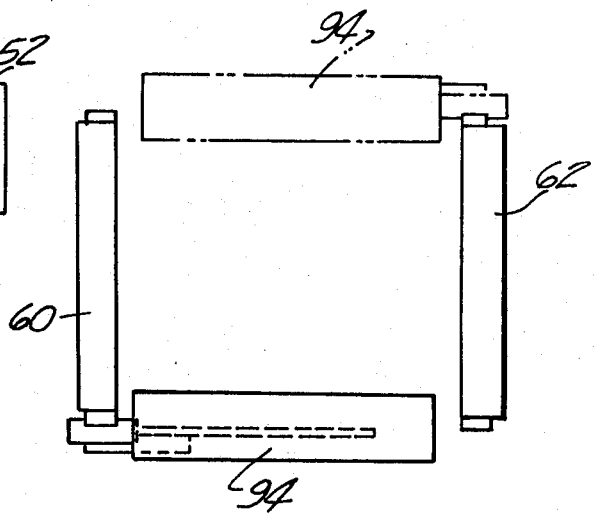
FIG. 7 is a diagrammatic view of a portion of the apparatus shown in FIG. 1.

This is best illustrated in FIG. 7 wherein when the second head 62 is utilized to perform the punching operation, a stock guide 94 is positioned as shown in solid lines and is attached to the first tool head 60. It should be understood that it may be desirable to also mount a stock guide (not shown) to the opposite side of the first head 60. The second stock guide (not shown) would be the mirror image of the stock guide 94.

When it is desired to change the apparatus so that the punching operation is performed by the first tool head 60 then the stock guide 94 is attached to the second tool head 62 as shown in phantom in FIG. 7 on the side opposite the apparatus from which it was. Again if a second stock guide is to be used it would be attached to the second tool head 62 on the side opposite to that which it was attached to the first tool head 60.

To utilize the piercing apparatus of the present invention a workpiece 30 is mounted to the clamp 28 of the holder 26. The clamp 28 is then adjusted to align the center of the workpiece 30 with the center of the index table 20.

Actuation of the cylinder 40, by reason of the connection to the piercing means 54 formed by the bar 74, moves the entire piercing means 54 toward and away from the holder 26 so that workpieces of different diameters can be accommodated by the apparatus of the present invention. The cylinder 40 is thus actuated to move the piercing means 54 to the proper position for receiving the workpiece 30 between the first tool head 50 and the second tool head 62.

The cylinder 70 is then actuated to move the punch 80 into piercing engagement with the workpiece 30 to form the first slot **30*b*. The table 20 is then indexed to the next position and the operation is repeated until piercing has been accomplished along the entire periphery of the workpiece 30**.

The present invention provides a single actuating means capable of producing piercing from either a forward or reverse direction. The bar 74 provides a means for selectively fixing either the first tool head 60 or the support plate 58 so that depending upon the position of the bar 74 the cylinder 70 will actuate either the first tool head 60 or the second tool head 62. The reversible stock guides 94 as well as the rollers 84 and 86 are provided to facilitate the change over from one mode of operation to the other.

Means are provided to readily accommodate workpieces through a wide range of sizes and the piercing of workpieces as provided by the present invention eliminates heretofore used expensive machining processes and permits turbine assemblies to be manufactured in a new and more economical manner.

It is apparent that although the present invention has been described with respect to apparatus for piercing a workpiece it could, with slight modifications and without departing from the intended scope of the present invention, be utilized to perform other work on a workpiece as well.

It is also apparent that although a single embodiment of the present invention has been described many changes and modifications can be made without departing from the spirit of the invention as expressed by the scope of the appended claims.

I claim:

1. Apparatus for performing work on a workpiece comprising:

a frame;

a workpiece mounted to said frame;

work performing means mounted to said frame and including a first tool head and a second tool head disposed on opposite sides of said workpiece;

means for selectively moving said first tool head into engagement with said workpiece while retaining said second tool head in a fixed position with respect to said workpiece or for moving said second tool head into engagement with said workpiece while retaining said first tool head fixed with respect to said workpiece wherein said last mentioned means comprises a support member fixedly connected with said second tool head whereby movement of said support member produces corresponding movement of said second tool head, means connecting said first tool head and said support member and operable upon actuation to move either said support member or said first tool head with respect to the other and means for selectively locking either said first tool head or said support member to said frame whereby when said support member is locked to said frame and said connecting means are actuated, said first tool head is moved toward said workpiece and when said first tool head is locked to said frame, said support member is moved away from said first tool head and said second tool head is moved toward said workpiece.

2. The apparatus as defined in claim 1 and in which said connecting means comprises a cylinder having one end connected to said support member and an opposite end connected to said first tool head.

3. The apparatus as defined in claim 1 and in which a punch is carried by one of said tool heads and a die is carried by the other.

4. The apparatus as defined in claim 3 and in which said die is provided with a lower arcuate surface and including rollers provided on said first and second tool heads to facilitate positioning of said die thereon.

5. The apparatus as defined in claim 4 and in which said punch is provided with a lower arcuate surface and including rollers provided on said first and second tool heads to facilitate positioning of said die thereon.

6. The apparatus as defined in claim 1 and including a stock guide detachably mounted to either said first tool head or said second tool head to support said workpiece, the same stock guide being mountable to whichever of said tool heads is fixed with respect to said workpiece.

7. The apparatus as defined in claim 1 and including means for moving said first tool head and said second tool head as a unit toward and away from said workpiece to accommodate workpieces of different sizes.

8. The apparatus as defined in claim 7 and in which said moving means comprises a cylinder carried by said frame, a support member slidably mounted in said frame and carrying said piercing means, said cylinder having a rod connected to said support member to produce movement of said support member and thus said piercing means upon extension and retraction of said cylinder.

9. Apparatus for performing work on a workpiece comprising:

a frame;

a workpiece mounted to said frame;

work performing means mounted to said frame and including a first tool head and a second tool head disposed on opposite sides of said workpiece;

means for selectively moving said first tool head into engagement with said workpiece while retaining said second tool head in a fixed position with respect to said workpiece or for moving said second tool head into engagement with said workpiece while retaining said first tool head in a fixed position with respect to said workpiece;

a metal working member carried by each of said tool heads, wherein one of said metal working members is provided with a lower arcuate surface and includes rollers provided on said respective tool head to facilitate positioning of said last mentioned metal working member thereon.

10. The apparatus as defined in claim 1 and in which said last mentioned means comprises a support member fixedly connected with said second tool head whereby movement of said support member produces corresponding movement of said second tool head, means connecting said first tool head and said support member and operable upon actuation to move either said support member or said first tool head with respect to the other and means for selectively locking either said first tool head or said support member to said frame whereby when said support member is locked to said frame and said connecting means are actuated said first tool head is moved toward said workpiece and when said first tool head is locked to said frame said support member is moved away from said first tool head and said second tool head is moved toward said workpiece.

11. The apparatus as defined in claim 10 and including a stock guide detachably mounted to either said first tool head or said second tool head to support said workpiece, the same stock guide being mountable to whichever of said tool heads is fixed with respect to said workpiece.

12. The apparatus as defined in claim 10 and in which said connecting means comprises a cylinder having one end connected to said support member and an opposite end connected to said first tool head.

13. The apparatus as defined in claim 9 and in which the other metal working member is provided with a lower arcuate surface and includes rollers provided on said respective tool head to facilitate positioning of the last mentioned metal working member thereon.

14. The apparatus as defined in claim 9 and including means for moving said first tool head and said second tool head as a unit toward and away from said workpiece to accommodate workpieces of different sizes.

15. The apparatus as defined in claim 9 wherein one of said metal working members is a die while the other metal working member is a punch.

* * * * *